United States Patent [19]

Friddell et al.

[11] 4,254,752

[45] Mar. 10, 1981

[54] METHOD OF AND APPARATUS FOR IMPROVING OPERATION OF A DIESEL ENGINE AT LIGHT LOADS

[75] Inventors: James F. Friddell, Huffman; Alves T. Ford, Deer Park; Mike L. Ferguson, Houston, all of Tex.

[73] Assignee: Stewart & Stevenson Services, Inc., Houston, Tex.

[21] Appl. No.: 75,852

[22] Filed: Sep. 17, 1979

[51] Int. Cl.[3] ..... F02D 9/06; F23L 17/02

[52] U.S. Cl. ..... 123/323; 123/65 BA; 60/324; 98/59

[58] Field of Search ..... 60/324; 98/59; 123/65 BA, 103 D, 107, 97 B, 323

[56] References Cited

U.S. PATENT DOCUMENTS

| | | | |
|---|---|---|---|
| 1,912,574 | 6/1933 | Ewing | 123/107 |
| 2,420,700 | 5/1947 | Curphy | 60/324 |
| 2,463,662 | 3/1949 | Wallace | 98/59 |
| 3,187,728 | 6/1965 | Friddell | 123/65 BA |
| 3,234,924 | 2/1966 | May | 60/324 |
| 3,446,010 | 5/1969 | Hopkins | 60/324 |
| 3,964,376 | 6/1976 | Janke | 98/59 |
| 4,205,706 | 6/1980 | Jasensky | 60/324 |

FOREIGN PATENT DOCUMENTS

| | | | |
|---|---|---|---|
| 964283 | 5/1957 | Fed. Rep. of Germany | 60/324 |
| 2801244 | 7/1978 | Fed. Rep. of Germany | 60/324 |

*Primary Examiner*—Wendell E. Burns

*Attorney, Agent, or Firm*—Fulbright & Jaworski

[57] ABSTRACT

Improving the operation of a diesel engine at light loads in which the engine includes a plurality of cylinders, a piston in each cylinder, a fuel injector for each cylinder, an air blower for supplying air to the cylinders and an exhaust manifold. A valve is pivotally positioned in the exhaust manifold, and biasing means is connected to the valve acting to bias the valve towards a closed position. The modulating valve restricts the flow from the manifold at light loads thereby maintaining a back pressure on the exhaust at lighter loads for improving engine performance, but opens wider by exhaust flow from the manifold at higher loads. An adjustable stop may be positioned in the path of travel of the valve preventing the valve from entirely closing. The valve may be a butterfly valve pivotally supported off-center and the biasing means may include a weight connected to a lever arm connected to the pivot supporting the valve. Improved fuel injectors provide less fuel than normal injectors at lighter loads.

6 Claims, 4 Drawing Figures

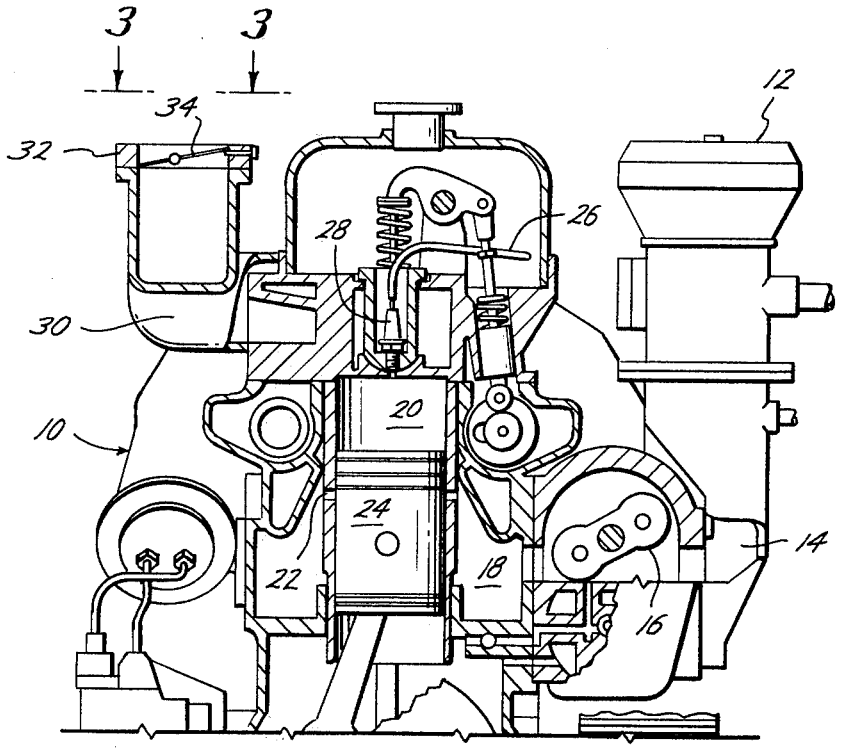
Fig. 1
Fig. 2
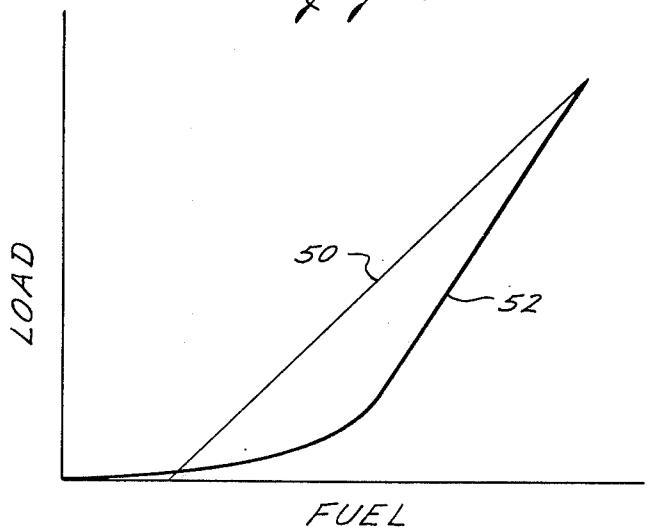

METHOD OF AND APPARATUS FOR IMPROVING OPERATION OF A DIESEL ENGINE AT LIGHT LOADS

BACKGROUND OF THE INVENTION

Engines are frequently over-sized in order to provide an anticipated maximum power requirement. However, this results in the engine being run under light loads, that is, under 50% of their rated loads for extended periods of operation. However, diesel engines have a shorter life, increased maintenance and increased air pollution when run at light loads. Diesel engines running at light loads have incomplete fuel combustion, excess fuel washes the cylinder, dilutes the oil and, causes carbon buildup in the engine requiring greater maintenance and repair and shortens the engine life.

The present invention is directed to a method of and an apparatus for improving the operation of a diesel engine at light loads, but which will not adversely affect the operation of the engine at higher loads.

SUMMARY

One feature of the present invention is the provision of improving engine operation of a diesel engine at light loads by providing a valve pivotally positioned in the exhaust manifold of the engine, and biasing the valve toward a closed position whereby the valve restricts the flow from the manifold at light loads and maintains a back pressure on the exhaust at light loads. The modulating valve is opened wider by exhaust flow from the manifold at higher loads. The modulating valve opens in proportion to the load on the engine and by maintaining a back pressure on the exhaust system at light load operations increases the air pressure in the engine and provides the following advantages: (1) improves the air-fuel ratio for providing a more complete combustion thereby reducing air pollution and reducing fuel consumption, (2) the increased air pressure forces a more constant volume of air into each cylinder to produce a more even combustion among the cylinders; (3) the increased air pressure improves the exhaust scavenging; (4) the engine temperature is slightly increased at light loads to provide more complete combustion; (5) the tendency of the exhaust system to "wet stack" or "slobber" at light loads is reduced; (6) a cleaner engine interior and exterior; (7) lubricating oil dilution from excess unburned fuel is reduced; (8) fuel consumption and oil consumption at light loads is reduced; and (9) lower maintenance, cost of repair and longer life is obtained.

A still further object of the present invention is the provision of providing improved fuel injectors connected to each cylinder which provide less fuel than normal fuel injectors at light loads which tends to provide for a more complete combustion of the fuel at lighter loads as well as decreasing fuel consumption but yet providing normal fuel quantities at higher loads.

Still a further object of the present invention is the provision of an adjustable stop for adjusting the closed position of the valve.

Yet a still further object of the present invention is the provision of a modulating butterfly valve in the exhaust manifold of a diesel engine which is pivotally supported off-center whereby the force of the exhaust acting on the valve to open on the valve acts on the differential area of the valve on opposite sides of the pivot.

Still a further object of the present invention is the provision of a weight connected to the valve which acts to bias the valve towards a closed position by being connected to a lever arm which in turn is connected to the pivot supporting the valve. If desired, a second weight may be connected to a second lever arm connected to the pivot which may be approximately twice the weight of the first weight and is offset from the first weight approximately 90° to provide a more constant force for biasing the valve closed regardless of its rotative position. The provision of two weights adds to the stability of the modulating valve.

Other and further objects, features and advantages will be apparent from the following description of a presently preferred embodiment of the invention, given for the purpose of disclosure and taken in conjunction with the accompanying drawings.

BRIEF DESCRIPTION OF THE DRAWINGS

FIG. 1 is an elevational view, partly in cross section, of the use of the present invention in combination with a two-cycle diesel engine, FIG. 2 is a graph showing a comparison of a conventional fuel injector and a preferred fuel injector showing load versus fuel.

DESCRIPTION OF THE PREFERRED EMBODIMENTS

Figure 3:
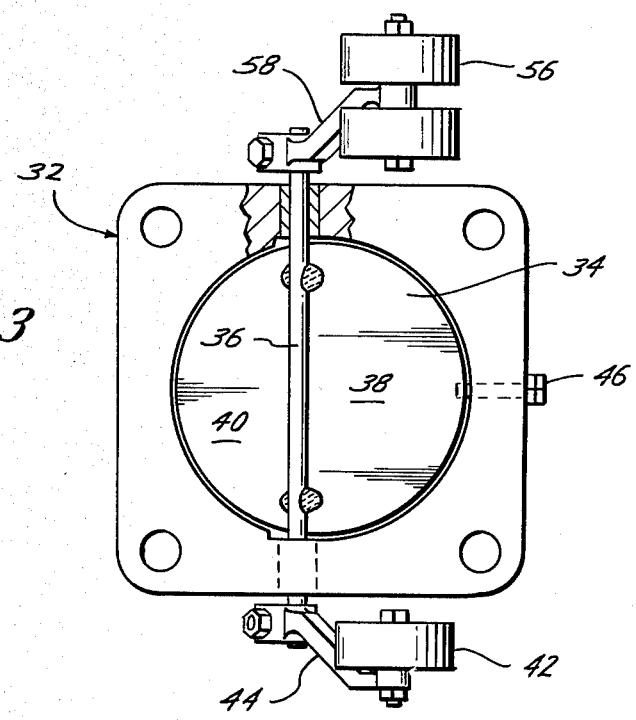
FIG. 3 is an enlarged elevational view of the exhaust valve of the present invention taken along line 3—3 of FIG. 1.

For purposes of illutration only, the present invention will be described as used on a two-cycle diesel engine, but the present invention may be used with other types of diesel engines.

Referring now to the drawings, and particularly to FIG. 1, a conventional two-cycle diesel engine is generally indicated by the reference numeral 10. Air is drawn through an air inlet 12, passes through a blower air intake manifold 14 by a positive displacement scavenger blower 16 to air box 18. Pressurized air in the air box 18 can flow into one of a plurality of cylinders 20 through an inlet port 22. Thus, when a piston 24 in a cylinder 20 moves below and opens a port 22, the air from the blower 16 is forced into the cylinder 20. Suitable diesel fuel lines 26 lead to an injector 28 at the top of each cylinder 20. As the piston rises from bottom dead center, it closes off the intake port 22 and the exhaust valve (not shown) closes. The air in the cylinder 20 is compressed as the piston continues to top dead center at which time fuel is injected and ignited to drive the piston downward. After the piston 24 descends and uncovers ports 22, the exhaust valve opens releasing burned gas through the exhaust manifold 30, and as the descending piston 24 uncovers the intake ports 22, fresh air is blown into the cylinders 20 under pressure from the blower 16 forcing out the exhaust gases and filling the cylinder 20 with fresh air. The above described diesel engine is conventional and no further description is believed to be necessary.

However, it is well known that running a diesel engine at idle or light loads, that is less than 50% of full loads, is much harder on the engine than running it at full loads. In running at light loads, the fuel combustion is incomplete causing excess fuel to wash the cylinder and dilute the lubricating oil, the fuel consumption is high for the output, the unburnt fuel coats the interior and exterior of the engine, the combustion among the cylinders is uneven and consequently the engine requires higher maintenance, increased repair cost, and a shorter life. The present invention is directed to a method and apparatus for use with a diesel engine which improves the engine operation of idle or light loads, but does not hamper the operation of the engine when the engine is operating at a more efficient higher loads.

Figure 4:
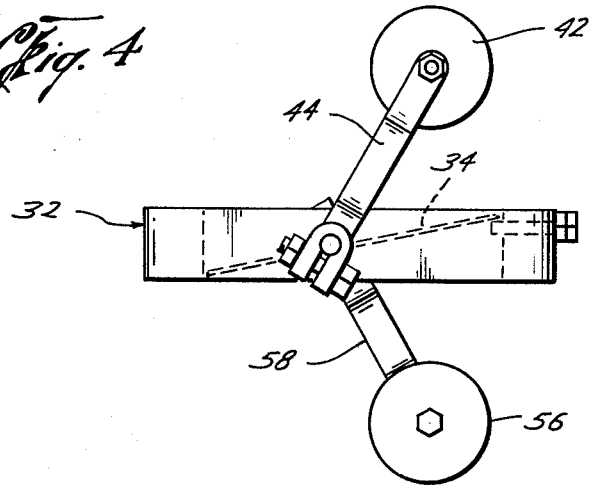
FIG. 4 is a side view of the exhaust valve of FIG. 3.

Referring now to FIGS. 1, 3 and 4, a load modulating exhaust valve, generally referred to by the reference numeral 32, is connected to the exhaust manifold 30 and is biased towards the closed position for restricting the flow from the manifold at no or light loads but opens wider by exhaust flow from the manifold 30 at higher loads. The valve 32 preferably includes a stainless steel butterfly valve 34 which is pivotally positioned in the exhaust manifold by being connected to a pivot rod 36 which is connected to the valve 34 at an offcenter position whereby the force of the exhaust acting to open the valve 34 acts on the differential area between the sides 38 and 40. This insures that the exhaust pressure always acts on the valve 34 to open it in the same direction. Suitable biasing means such as a weight 42 is provided connected to a lever arm 44 which in turn is connected to the pivot rod 36 acting to move the valve 34 to a closed position. Preferably, the valve 34 does not entirely block off the exhaust manifold 30 and suitable stop means such as screw 46 may be provided which can be adjustably screwed in and out to act against the bottom side of the valve 34 to adjust its closed position. As shown in FIGS. 1, 3 and 4, the weight 42 will bias the valve 34 to a closed position but when the pressure of the exhaust increases the valve will modulate open and will generally move to a open position at higher loads where the valve will not interfere with the efficient operation of the engine 10 at full loads. The modulating valve 34 maintains a back pressure of three inches of mercury under no load and idle conditions on the exhaust system which provides the following advantages: (1) increases the pressure in the air box 18 to improve exhaust scavenging, (2) increases the air box pressure to improve the air-fuel ratio for more complete combustion, (3) increases the pressure in the air box 18 for forcing a more constant volume of air into each of the cylinders 20, (4) increases slightly the temperature of operation at light loads which will improve complete combustion, (5) will improve light or no load fuel consumption, (6) will improve lubricating oil consumption, (7) will prevent lubricating oil dilution from excess unburned fuel, and (8) will provide a cleaner interior and exterior to the engine.

Another feature of the present invention is the provision of the use of fuel injectors 28 which will coact with the valve 34 to provide the advantages mentioned above. Referring now to FIG. 2, a graph 50 is shown of the fuel versus load characteristic of a conventional injector. However, it has been found that the amount of fuel provided by such an injector at no load or light loads is excessive and inconsistent and contributes to the problems noted above. Therefore, it has been found advantageous to utilize an injector which provides less fuel than normal injectors at light loads and generally normal amounts of fuel at high loads. Referring to FIG. 2, the graph 52 indicates the characteristic of a suitable injector such as the type 70 SS sold by Stewart & Stevenson Services, Inc. It is noted that the graph 52 has a gradual and small increase of fuel from no load to light loads to provide a more even fuel consumption, while the conventional injector shown in the graph 50 provides too much or not enough fuel between no loads and light loads.

Referring now to FIGS. 3 and 4, a second weight 56 may be provided connected to a second lever arm 58 which in turn is clamped to the pivot rod 36 for also acting bias the butterfly valve 34 to the closed position. Preferably, the second weight 56 is approximately twice the weight of the first weight 42 and as shown in FIG. 4 is offset from the first weight 56 by approximately 90° to provide a more constant force for biasing the valve 34 to the closed position regardless of its rotative position.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will readily suggest themselves to those skilled in the art and which are encompassed within the spirit of the invention and the scope of the appended claims.

What is claimed is:

1. In combination with a diesel engine having a plurality of cylinders, a piston in each cylinder, a fuel injector for each cylinder, an air blower for supplying air to the cylinders and an exhaust manifold, the improvement of means for improving engine operation at light loads comprising, a modulating valve pivotly positioned in the exhaust manifold, said valve is a butterfly valve which is pivotly supported off center whereby the force of the exhaust acting to open the valve acts on the differential area of the valve on opposite sides of the pivot, a weight connected to the valve acting to bias the valve toward a closed position, said weight is connected to a lever arm connected to a pivot supporting the valve, said valve restricting the flow from the manifold at lower loads thereby maintaining a back pressure on the exhaust at lighter loads.

2. The apparatus of claim 1 wherein said valve is biased to provide a back pressure in the exhaust manifold at low loads of 3" Hg.

3. In combination with a diesel engine having a plurality of cylinders, a piston in each cylinder, a fuel injector for each cylinder, an air blower for supplying air to the cylinders and an exhaust manifold, the improvement of means for improving engine operation at light loads comprising, a modulating valve pivotly positioned in the exhaust manifold, a weight connected to the valve acting to bias the valve toward a closed position, said valve restricting the flow from the manifold at lower loads thereby maintaining a back pressure on the exhaust at lighter loads, the weight is connected to a lever arm connected to a pivot supporting the valve, and a second weight connected to a second lever arm connected to the pivot, said second weight being approximately twice the weight of the first weight and being offset from the first weight approximately ninety degrees.

4. In combination with a diesel engine having a plurality of cylinders, a piston in each cylinder, an air blower for supplying air to the cylinders and an exhaust manifold, the improvement of means for improving engine operation at light loads comprising, a fuel injector connected to each cylinder, said injectors providing less fuel than normal at light loads, a valve pivotly positioned in the exhaust manifold, said valve is a butterfly valve which is pivotly supported off center whereby the force of the exhaust acting to open the valve acts on the differential area of the valve on opposite sides of the pivot, weight means connected to the valve acting to bias the valve towards a closed position, said weight is connected to a lever arm connected to a pivot supporting the valve, stop means positioned in the path of travel of the valve preventing the valve from entirely closing, and said valve restricting the flow from the manifold at light loads thereby maintaining a back pressure on the exhaust at lighter loads, but opens wider by exhaust flow from the manifold at higher loads.

5. The apparatus of claim 4 wherein said valve is biased to provide a back pressure in the exhaust manifold of 3" Hg.

6. In combination with a diesel engine having a plurality of cylinders, a piston in each cylinder, an air blower for supplying air to the cylinders and an exhaust manifold, the improvement of means for improving engine operation at light loads comprising, a fuel injector connected to each cylinder, said injectors providing less fuel than normal at light loads, a valve pivotly positioned in the exhaust manifold, biasing means connected to the valve acting to bias the valve towards a closed position, stop means positioned in the path of travel of the valve preventing the valve from entirely closing, said valve restricting the flow from the manifold at light loads thereby maintaining a back pressure on the exhaust at lighter loads, but opens wider by exhaust flow from the manifold at higher loads, said biasing means includes a weight connected to a lever arm connected to a pivot supporting the valve, and a second weight connected to a second lever arm connected to the pivot, said second weight being approximately twice the weight of the first weight and being offset from the first weight approximately ninety degrees.

* * * * *